US009289760B2

(12) United States Patent
Williams et al.

(10) Patent No.: US 9,289,760 B2
(45) Date of Patent: Mar. 22, 2016

(54) APPARATUS FOR PROVIDING COOLANT FLUID

(75) Inventors: Gerald G. Williams, St. Charles, MO (US); Andrew D. Hager, O'Fallon, MO (US); George S. Wilson, Lawrence, KS (US); William Scott Jeffress, Baldwin City, KS (US); Frank J. Schoenen, Lawrence, KS (US)

(73) Assignees: Cannon Design, Inc., Grand Island, NY (US); University of Kansas, Lawrence, KS (US)

( * ) Notice: Subject to any disclaimer, the term of this patent is extended or adjusted under 35 U.S.C. 154(b) by 1980 days.

(21) Appl. No.: 12/393,362

(22) Filed: Feb. 26, 2009

(65) Prior Publication Data

US 2010/0216382 A1 Aug. 26, 2010

(51) Int. Cl.
*B01L 1/00* (2006.01)

(52) U.S. Cl.
CPC ..... *B01L 1/50* (2013.01); *B01L 2300/185* (2013.01)

(58) Field of Classification Search
CPC ..... B01L 1/50; B01L 2300/185
USPC ..... 454/49–67; 165/299, 300, 275, 71; 62/48.1, 58, 59, 47, 244, 100, 98, 99, 62/79, 268, 270, 261, 259.2, 259.1
See application file for complete search history.

(56) References Cited

U.S. PATENT DOCUMENTS 3,326,277 A * 6/1967 Osborne ..... 165/62
3,745,908 A * 7/1973 Mayberry ..... 454/57
4,415,847 A * 11/1983 Galloway ..... 320/150
4,534,281 A 8/1985 Parks et al.
4,718,478 A * 1/1988 Huber ..... 165/220
5,058,391 A * 10/1991 Periot ..... 62/238.6
5,113,927 A * 5/1992 Kedar et al. ..... 165/278
5,566,062 A * 10/1996 Quisenberry et al. ..... 363/89
5,579,650 A 12/1996 Cleland et al.
5,634,351 A * 6/1997 Larson et al. ..... 62/259.2
5,687,707 A * 11/1997 Prasser ..... 126/299 D
5,716,267 A 2/1998 Hambleton et al.
7,051,797 B2 * 5/2006 de Leeuw ..... 165/158
2002/0007932 A1 * 1/2002 Egara ..... 165/41

(Continued)

OTHER PUBLICATIONS

Thermo Scientific NESLAB HX Series Recirculating Chiller, Thermo Scientific Manual P/N U00744, pp. 1-75 (Mar. 26, 2008).

(Continued)

*Primary Examiner* — John K Fristoe, Jr.
*Assistant Examiner* — Daphne M Barry
(74) *Attorney, Agent, or Firm* — Simpson & Simpson, PLLC

(57) ABSTRACT

An apparatus for providing coolant fluid to a device, the apparatus includes a heat exchanger having a hot side and a cold side. The cold side is in fluid communication with a chilled fluid supply and adapted to receive a first fluid from the chilled fluid supply in a first inlet and return the first fluid from the cold side to the chilled fluid supply. The cold side and the chilled fluid supply form a first fluid circuit. The apparatus further includes a second fluid circuit in fluid communication with the hot side, means for introducing a second fluid within the second fluid circuit and integral thereto, a pump integral to the second fluid circuit and adapted to transmit a second fluid within the second fluid circuit and means for controlling a rate of flow of the second fluid within the second fluid circuit. The device is within the second fluid circuit and the means for controlling the rate of flow operates in the absence of internal recirculation.

21 Claims, 6 Drawing Sheets

(56) References Cited

U.S. PATENT DOCUMENTS

| | | | | |
|---|---|---|---|---|
| 2004/0248077 | A1* | 12/2004 | Rodriguez et al. | 435/4 |
| 2006/0042289 | A1* | 3/2006 | Campbell et al. | 62/259.2 |
| 2010/0216382 | A1 | 8/2010 | Williams et al. | |
| 2011/0258837 | A1* | 10/2011 | Scannon et al. | 29/592 |
| 2012/0100789 | A1 | 4/2012 | Liebsch | |

OTHER PUBLICATIONS

Thermo Scientific NESLAB System III Heat Exchanger, Thermo Scientific Manual P/N U00678, pp. 1-28 (Dec. 7, 2006).

Thermo Scientific NESLAB ThermoFlex2500, pp. 1-4 (2007).

Thermo Electron Corporation LESLAB RTE and EX Series Bath Circulators, pp. 1-12 (undated).

Thermo Electron Corporation NESLAB ULT Series Bath Circulators, pp. 10-12 (undated).

Thermo Electron Corporation NESLAB RTE CB Series Cold Baths, pp. 14-15 (undated).

Thermo Electron Corporation NESLAB CB Series Cryotrol, p. 16 (undated).

Thermo Electron Corporation NESLAB Merlin Series Recirculating Chillers, pp. 17-20 (undated).

Thermo Electron Corporation NESLAB CC Series Immersion Coolers, pp. 21-25 (undated).

Thermo Electron Corporation NESLAB ThermoFlex 900 Recirculating Chiller, pp. 1-3 (undated).

Thermo Electron Corporation NESLAB ThermoFlex 1400 Recirculating Chiller, pp. 1-4 (2006).

Reflux Condensers, Jencon Laboratory Catalog, p. 794 , created on Oct. 2005, modified Apr. 2006.

* cited by examiner

APPARATUS FOR PROVIDING COOLANT FLUID

FIELD OF THE INVENTION

The invention broadly relates to heat exchangers, more specifically to a heat exchanger arranged to provide coolant fluid, and even more particularly to a heat exchanger adapted to be mounted within a laboratory fume hood and arranged to provide coolant fluid.

BACKGROUND OF THE INVENTION

Laboratory environments present a multitude of challenges for instrument design and the conducting of experiments and procedures. In particular, chemistry labs of various types often require specific and dedicated equipment for a variety of experiment setups. For example, some apparatus require the circulation of cooling fluid therein. Such equipment may include, but are not limited to, rotary evaporators, lasers, reflux condenser columns, distillation columns, condenser columns, etc. These types of equipment are commonly used in universities, research and development and government agencies worldwide.

Various techniques are known in the art for providing the necessary cooling to the foregoing equipment. For example, tap water may be directly used for cooling a device. Thus, in the instance of a condenser column, tap water flows through and within the column's outer jacket and is subsequently disposed of down a municipal sewer drain. This arrangement suffers from several drawbacks which include a large, wasteful use of a natural resource, i.e., water, potential flooding in a lab, poor temperature control and the elimination of sinks for other uses. Similarly, a building water cooling system may be present and used instead of conventional tap water. In like fashion, these systems, in addition to the aforementioned drawbacks, also suffer from several other drawbacks which can include water pressures at elevated or dangerous levels and temperatures which are too cool. The following calculations assist with understanding the sheer magnitude of the potential of the wasted natural resource. When using tap or chilled water as a source of cooling water, a single fume hood may consume a half (½) gallon of water per minute, which results in thirty (30) gallons per hour, seven hundred twenty (720) gallons per day and two hundred sixty-two thousand eight hundred (262,800) gallons per year. It should be appreciated that this is the potential water consumed from a single fume hood and many university and research laboratories include far more than a single fume hood. For example, a company performing extensive research and having one hundred (100) chemists could easily use five million two hundred thousand (5,200,000) gallons of water per year in support of its chemists. Furthermore, as in the instance of using a chilled water supply, high fluid pressures may be impractical for use with all laboratory equipment as some equipment may rupture when subjected to elevated pressures.

Further options for providing cooling fluid to a laboratory setup include using what are commonly referred to as circulating water baths and/or water-to-water heat exchangers. It should be appreciated that although some of these devices are referred to as "water baths," it is common to use anti-freezing agents such as propylene or ethylene glycol within the circulating fluid when the required temperature range drops below the freezing point of water, i.e., 32° Fahrenheit or 0° Celsius. Water baths may be permanently installed in a particular location or may be moved from location to location as needed. This flexibility is sometimes desirable when demand for cooling fluid is low; however, if demand for cooling fluid is high, multiple water baths are necessary. Even though these baths provide this flexibility, they suffer from drawbacks such as being expensive, i.e., approximately three to eight thousand dollars per unit, they are large, noisy, provide too great of a flow rate and/or too much pressure. Additionally, such systems are not appropriate for placement within a fume hood as their size prohibits it and the corrosive environment within a fume hood will degrade device enclosures and internal components. Moreover, these devices are fixed in size, shape and usage, and therefore do not offer scaling up to larger sizes or ease of servicing.

As can be derived from the variety of devices and methods directed at providing cooling fluids to laboratory equipment, many means have been contemplated to accomplish the desired end, i.e., consistent and controllable flow of cooling fluid. Heretofore, tradeoffs between costs, resource consumption and flexibility were required. Thus, there is a long-felt need for an apparatus for providing cooling fluid which is decoupled from tap or chilled water sources to prevent flooding, which is small in size, scalable, movable, quiet and inexpensive. There is a further long-felt need for a laboratory fume hood comprising the foregoing apparatus for providing cooling fluid. There is also a long-felt need for a method of providing cooling fluid to a plurality of locations/devices using a common source of chilled water.

BRIEF SUMMARY OF THE INVENTION

The present invention broadly comprises an apparatus for providing coolant fluid to a device, the apparatus including a heat exchanger having a hot side and a cold side. The cold side is in fluid communication with a chilled fluid supply and adapted to receive a first fluid from the chilled fluid supply in a first inlet and subsequently return the first fluid from a first outlet of the cold side to the chilled fluid supply. The cold side and the chilled fluid supply form a first fluid circuit. The present invention apparatus further includes a second fluid circuit in fluid communication with the hot side of the heat exchanger and means for introducing a second fluid within the second fluid circuit and integral thereto. Furthermore, the present invention further includes a pump integral to the second fluid circuit and adapted to transmit a second fluid within the second fluid circuit, and includes means for controlling a rate of flow of the second fluid within the second fluid circuit. The device is within the second fluid circuit and the means for controlling the rate of flow operates in the absence of internal recirculation. In some embodiments, the apparatus includes means for removing air from the second fluid circuit. In these embodiments, the means for removing air from the fluid circuit is an automatic air vent or a manual air vent. In other embodiments, the apparatus includes means for controlling the rate of flow of the second fluid within the second fluid circuit, and in some of these embodiments, the means for controlling a rate of flow of the second fluid comprises a valve selected from the group consisting of: a gate valve, a plug valve, a globe valve, a butterfly valve, a diaphragm valve, a ball valve, a cone valve and a needle valve. In still further embodiments, the pump is a constant speed pump or a variable speed pump. In some embodiments, the heat exchanger is a plate heat exchanger or a shell and tube heat exchanger, while in other embodiments, the apparatus further includes means for removing the second fluid from the second fluid circuit. In still yet other embodiments, the means for controlling the rate of flow of the second fluid is a balance valve and the balance valve is adapted to maintain the rate of flow of said second fluid within the second fluid circuit. In still yet further embodiments, the apparatus further comprises a mounting plate having a surface area, wherein the heat exchanger, the means for introducing the second fluid, the pump and the means for controlling the rate of flow of the second fluid are all arranged within the surface area, and the mounting plate is adapted to be releasably secured to an interior wall of a fume hood. The present invention also broadly comprises a laboratory fume hood including the foregoing present invention apparatus arranged within the fume hood. It should be appreciated that in some embodiments, the second fluid circuit is a sealed system.

In a further embodiment, the present invention comprises a laboratory fume hood including a vented enclosure having a chilled fluid inlet and a chilled fluid outlet arranged therein. Moreover, the laboratory fume hood includes a heat exchanger having a hot side and a cold side and the cold side is in fluid communication with a chilled fluid supply via the chilled fluid inlet and outlet, and is adapted to receive a first fluid from the chilled fluid outlet in a first inlet and return the first fluid from the cold side to the chilled fluid inlet via a first outlet. In these embodiments, the cold side and the chilled fluid supply form a first fluid circuit. The present invention laboratory fume hood further includes a second fluid circuit in fluid communication with the hot side of the heat exchanger, means for introducing a second fluid within the second fluid circuit which is integral thereto and still further includes a pump integral to the second fluid circuit and adapted to transmit a second fluid within the second fluid circuit. In some embodiments, the vented enclosure further includes at least one interior wall and the is heat exchanger is mounted on the at least one interior wall. In other embodiments, the present invention laboratory fume hood includes a device in fluid communication and within the second fluid circuit, wherein at least a portion of the device is cooled by the second fluid, and in some of these embodiments the device is selected from the group consisting of: a rotary evaporator, a laser, a distillation column, a condenser column and combinations thereof.

In yet a further embodiment, the present invention comprises a method of providing coolant fluid to at least one device. The method includes the steps of: mounting a heat exchanger on an interior wall of a fume hood; circulating a first fluid from a chilled fluid supply within a cold side of a heat exchanger; introducing a second fluid within a fluid circuit, the fluid circuit integral with a hot side of the heat exchanger; circulating the second fluid within the fluid circuit via a first pump; and, cooling the at least one device via the second fluid. In some embodiments, the at least one device includes a plurality of devices and each of the plurality of devices are located within the fume hood, while in still yet further embodiments, the at least one device includes a plurality of devices and at least one of the plurality of devices is located within the vented enclosure and at least one of the plurality of devices is located outside of the fume hood.

It is a general object of the present invention to provide cooling fluid apparatus having a minimal volume which can provide cooling fluid in an appropriate pressure range, flow rate and temperature range.

It is another general object of the present invention to isolate a building chilled fluid loop from the device chilled fluid loop thereby preventing flooding due to connection failures.

It is yet another object of the present invention to provide a cooling fluid apparatus which is plug and play, i.e., the apparatus can be moved from one location to another with a minimal setup and configuration and to provide a cooling fluid apparatus that can be mounted within the vented enclosure of a fume hood.

It is still yet another object of the present invention to provide cooling fluid in an environmentally friendly way and at a minimum of cost.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that as used herein the term "fluid" is intended to mean any fluid capable and suitable for use as a heat exchanging medium, e.g., water, propylene glycol, ethylene glycol, etc., and that the description of such fluids does not limit the scope of the claimed invention to any particular fluid discussed. Although any methods, devices or materials similar or equivalent to those described herein can be used in the practice or testing of the invention, the preferred methods, devices, and materials are now described.

Figure 1:
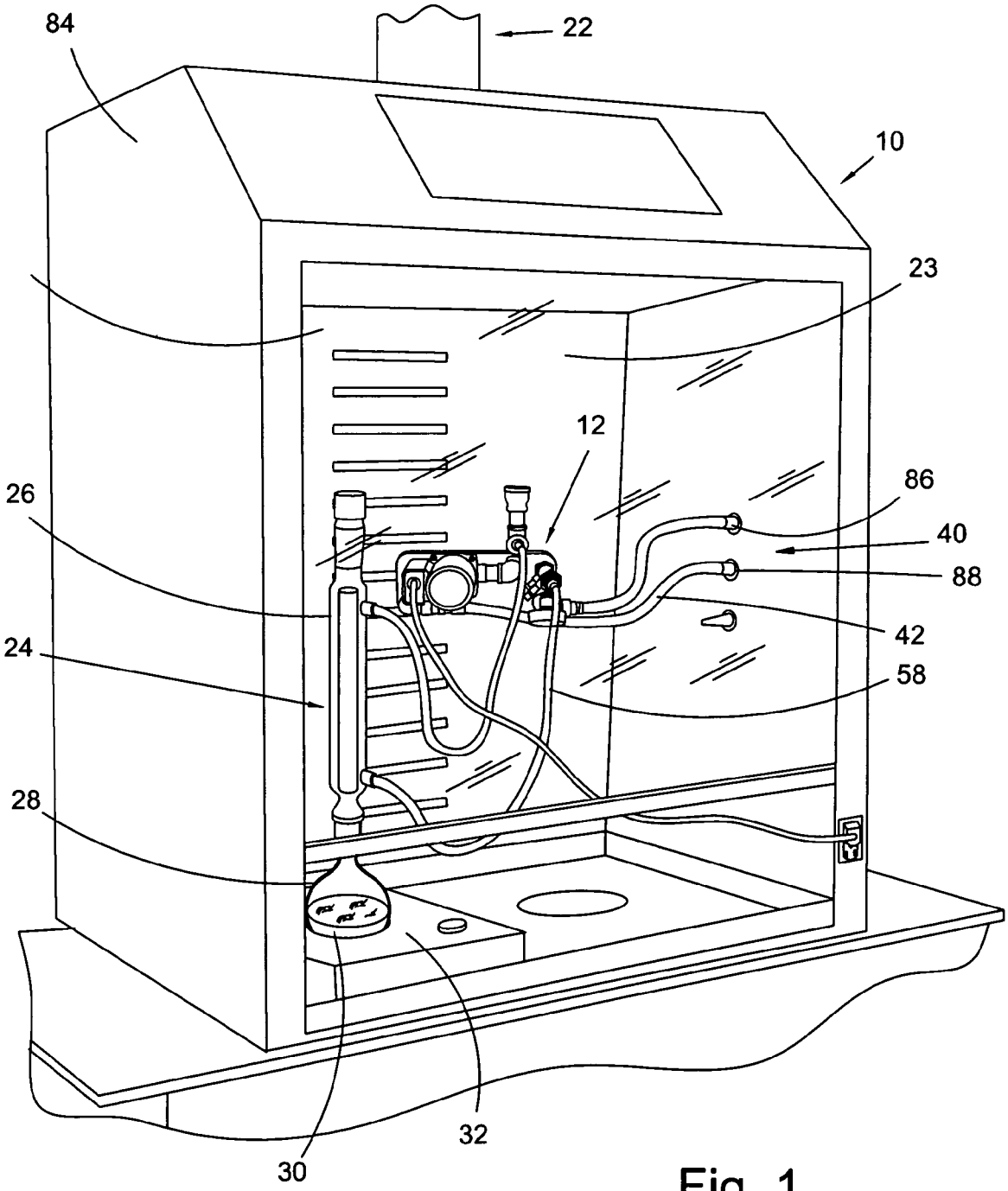
FIG. 1 is a perspective view of a laboratory fume hood including an embodiment of the present invention apparatus for providing cooling fluid.
Figure 2:
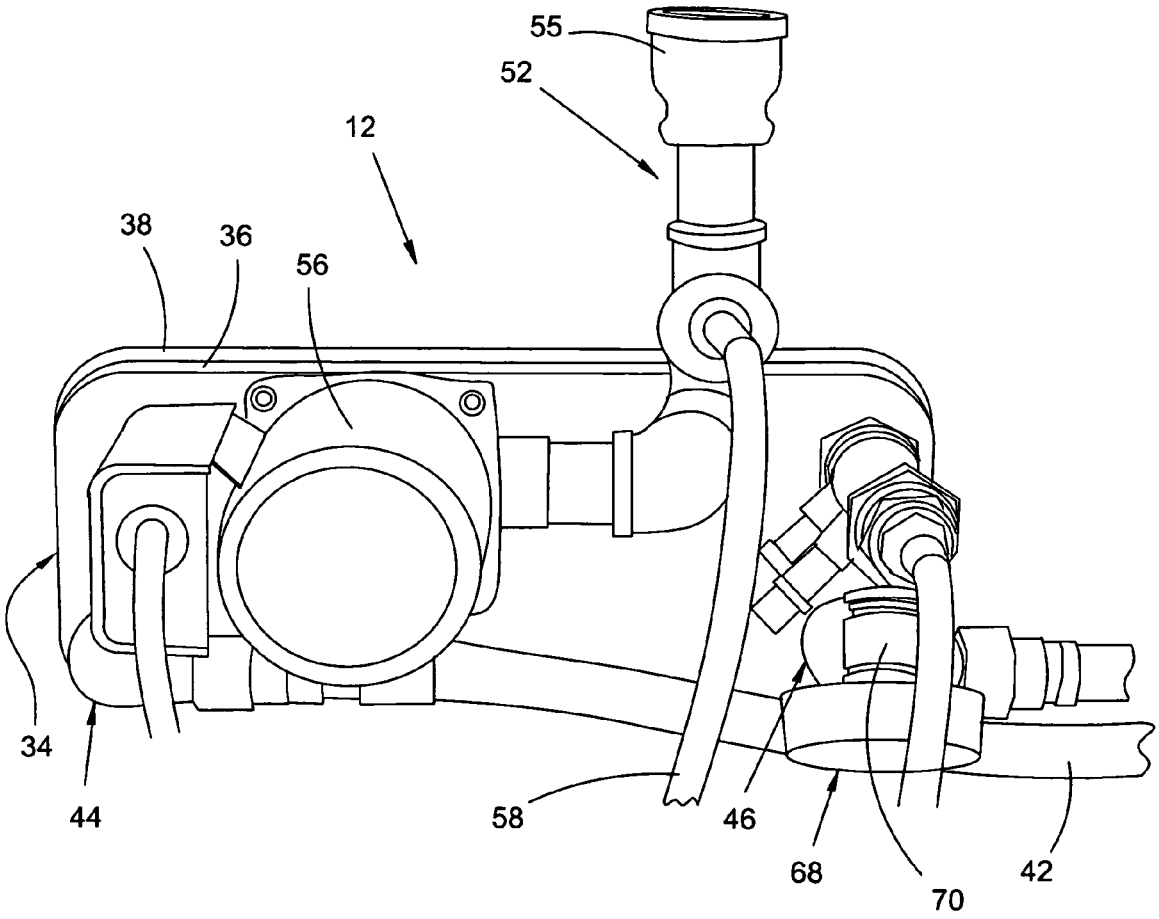
FIG. 2 is an enlarged perspective view of the present invention apparatus shown in FIG. 1.
Figure 3:
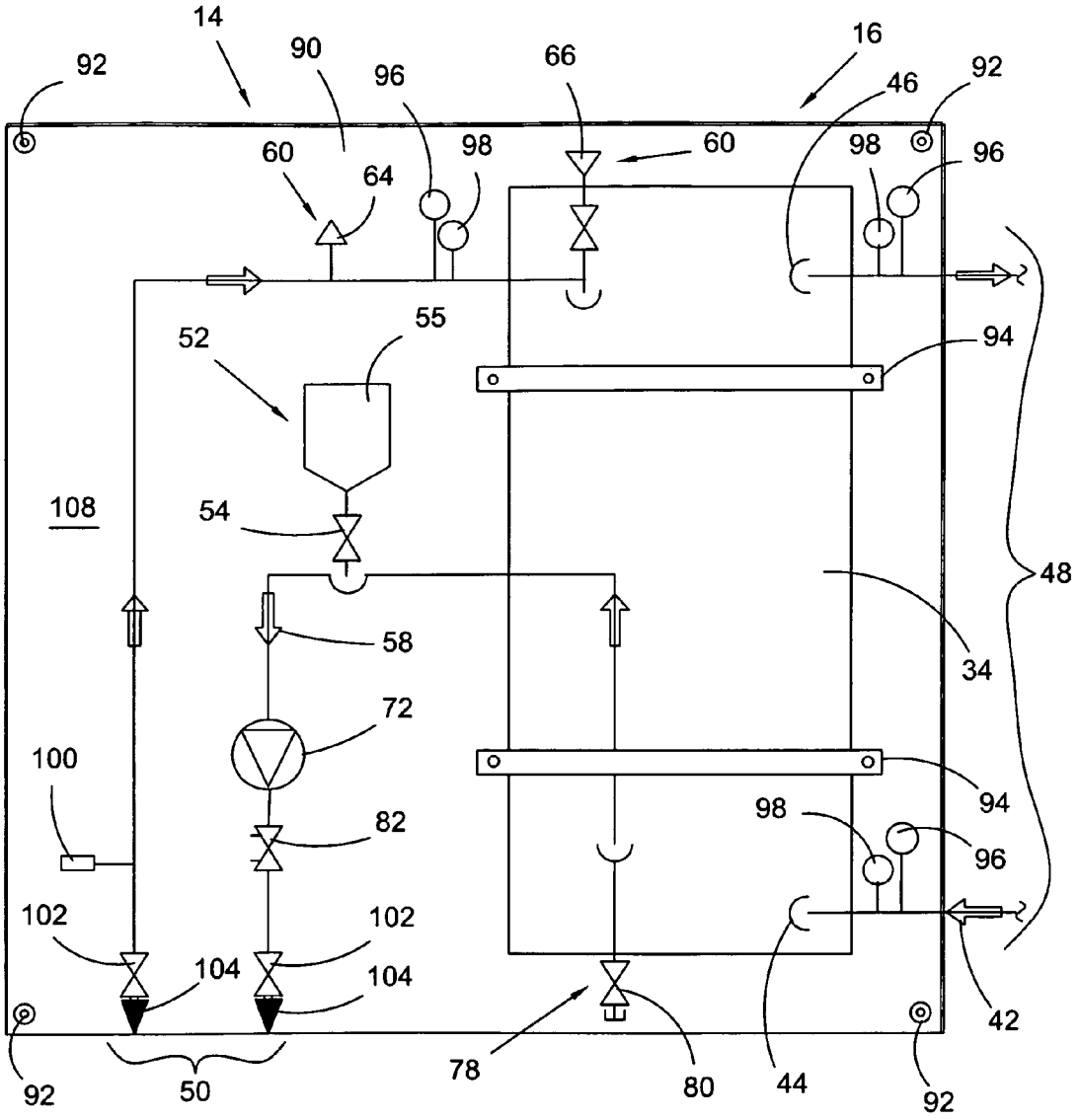
FIG. 3 is a schematic layout of another embodiment of a present invention apparatus for providing a cooling fluid.
Figure 4:
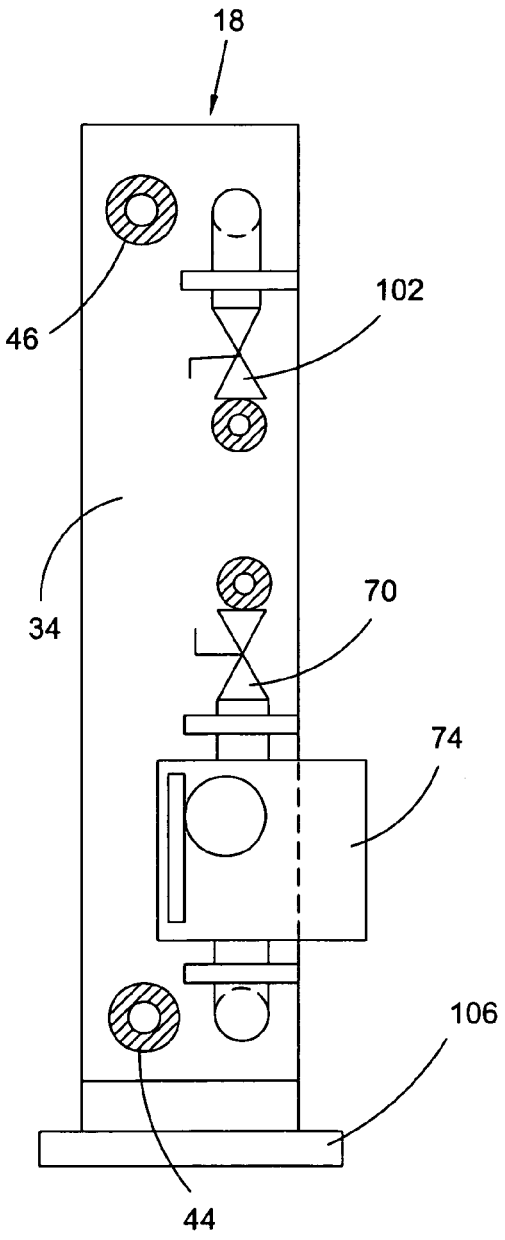
FIG. 4 is a front elevational view of yet another embodiment of a present invention apparatus for providing a cooling fluid.
Figure 5:
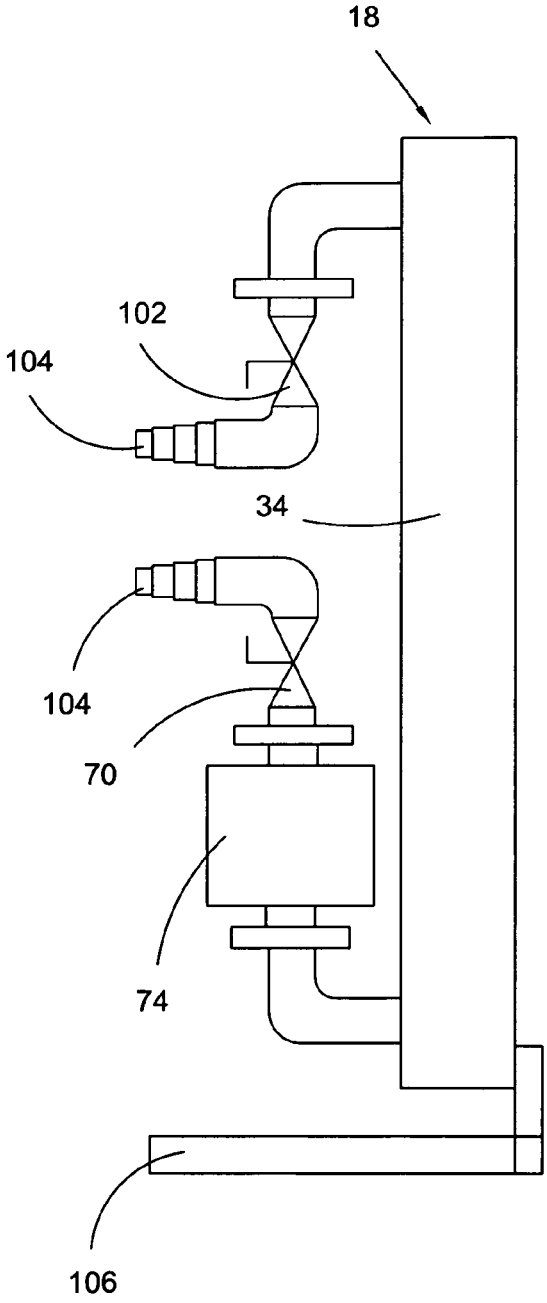
FIG. 5 is a right elevational view of a the embodiment of the present invention apparatus shown in FIG. 4.
Figure 6:
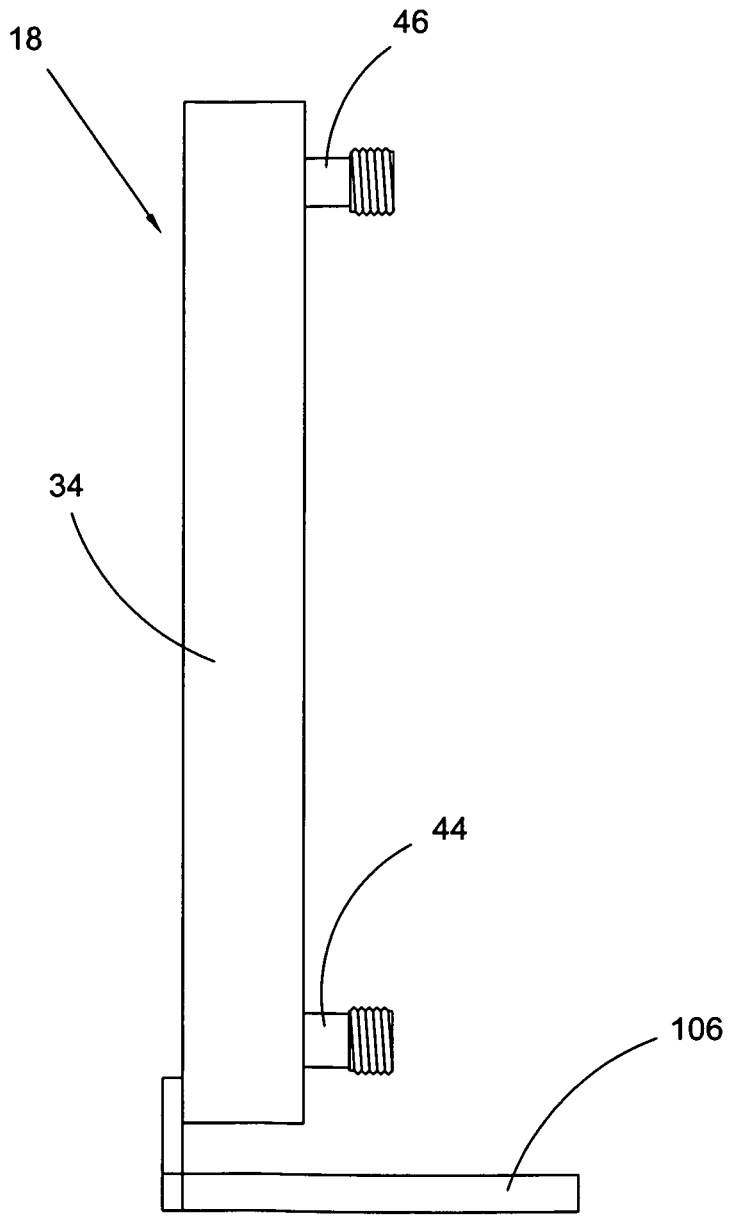
FIG. 6 is a left elevational view of a the embodiment of the present invention apparatus shown in FIG. 4; and, FIG. 7 is a perspective view of a preferred embodiment of a present invention apparatus for providing a cooling fluid.
Figure 7:
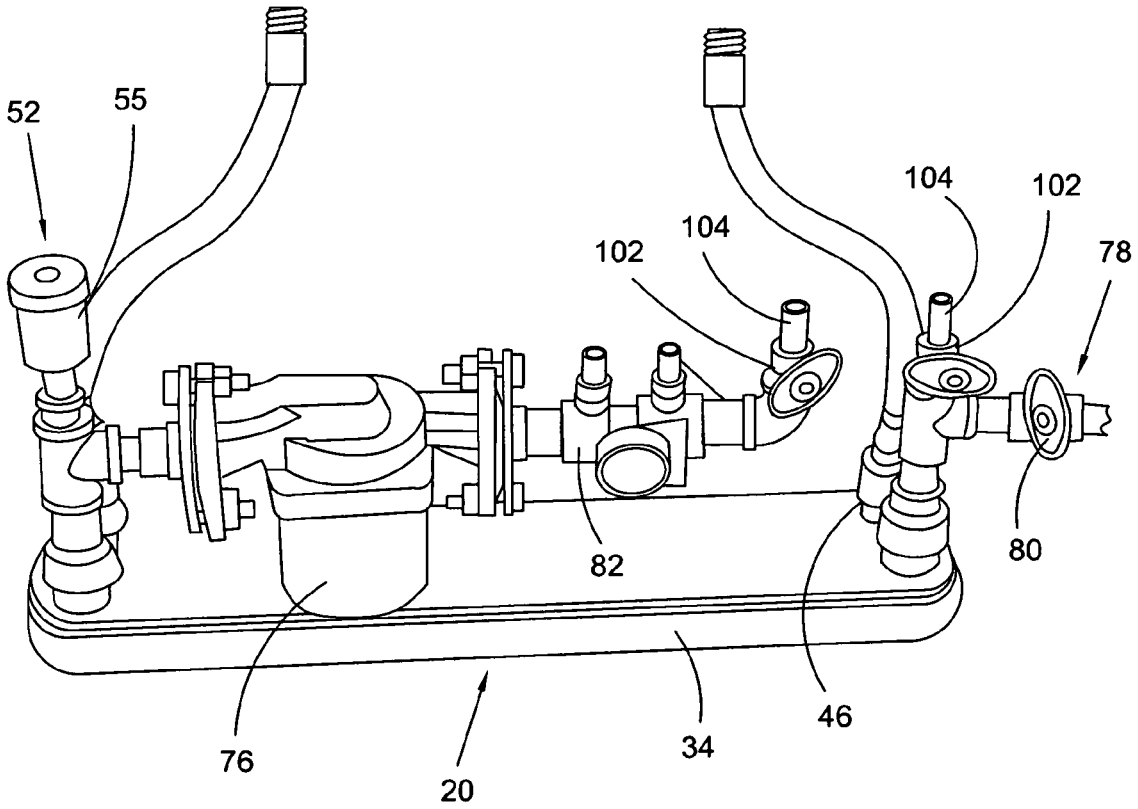

Adverting now to the figures, FIG. 1 shows a perspective view of laboratory fume hood 10 including an embodiment of the present invention apparatus for providing cooling fluid, i.e., apparatus 12, while FIG. 2 shows an enlarged perspective view of apparatus 12. FIG. 3 shows schematic layout 14 of another embodiment of a present invention apparatus for providing a cooling fluid, i.e., apparatus 16. FIG. 4 shows a front elevational view of yet another embodiment of a present invention apparatus for providing a cooling fluid, i.e., apparatus 18, FIG. 5 shows a right elevational view of apparatus 18 and FIG. 6 shows a left elevational view of apparatus 18. FIG. 7 shows a perspective view of a preferred embodiment of a present invention apparatus for providing a cooling fluid, i.e., apparatus 20. The following is best understood in view of FIGS. 1 through 7.

Fume hood 10 includes an embodiment of the present invention apparatus for providing coolant fluid, i.e., apparatus 12. As is common with laboratory fume hoods, the air within fume hood 10 is exhausted through venting means 22, and such venting means may merely include means for exhausting the air to the environment outside the lab, e.g., at the building roof level, or may include air scrubbing capabilities when required by the types of materials used in the fume hood. Apparatus 12, mounted on interior wall 23, is arranged to providing coolant fluid to device 24, e.g., reflux column 26 installed above and within round bottom flask 28. In such an arrangement, solution 30 within flask 28 is heated by heating mantle 32. As solution 30 is heated, some portion of the solution volatilizes, i.e., passes off as vapor. In order to maintain the concentration ratios of components within solution 30, any vapor that is driven off must be returned to the solution. Thus, reflux column 26 is included above flask 28 is having a cooling fluid flowing thereabout, so that as vapor rises within column 26, the vapor condenses due to the relative cooled temperature of column 26 and subsequently returns in liquid form to solution 30 in flask 28. The foregoing description is but one example of how the coolant fluid provided by an embodiment of the present invention apparatus may be used. As one of ordinary skill in the art appreciates, a number of other uses of such coolant fluid also exist, e.g., rotary evaporators, lasers, distillation columns, condenser columns, etc., and such uses are within the spirit and scope of the claimed invention.

Apparatus 12 comprises heat exchanger 34 having hot side 36 and cold side 38. It should be appreciated that although only two plate regions are shown in the Figures, i.e., corresponding to hot side 36 and cold side 38, one of ordinary skill in the art should appreciate that the heat exchanger may comprise a plate heat exchanger having a plurality of plates, may comprise a shell and tube heat exchanger as are well known in the art and therefore not depicted in the figures, or may comprise any other type of heat exchanger device having hot and cold sides arranged to exchange heat therebetween. Cold side 38 is in fluid communication with chilled fluid supply 40 and adapted to receive first fluid 42 from chilled fluid supply 40 in first inlet 44 and return first fluid 42 from first outlet 46 of cold side 38 to chilled fluid supply 40. Cold side 38 and chilled fluid supply 40 collectively form first fluid circuit 48. As used herein, the chilled fluid supply may be a building wide or area wide, e.g., college campus, supply of water or other fluid that is chilled to a particular temperature for a variety of uses, or may be a localized supply of the same, e.g., a single laboratory supply. With such an arrangement, water may be drawn from the chilled fluid supply and disposed of down a drain, or for more environmentally conscious reasons, may be returned to the chilled water supply for re-chilling and later recirculation. Apparatus 12 further comprises second fluid circuit 50 in fluid communication with hot side 36. Means for introducing a second fluid 52 is arranged within second fluid circuit 50 and is integral thereto. Means for introducing a second fluid may include a sealable opening, e.g., valve 54 (See FIG. 3) and/or fill tube 55 (See FIGS. 2, 3 and 7), or may include a connection point for a hose or the like, e.g., quick disconnect fitting. Furthermore, apparatus 12 comprises pump 56 integral to second fluid circuit 50 and adapted to transmit second fluid 58 within second fluid circuit 50. As can be seen in the figures, device 24 is within second fluid circuit 50.

Some embodiments of the present invention apparatus for providing coolant fluid, e.g., apparatus 16, further comprise means for removing air 60 from the second fluid circuit, e.g., second fluid circuit 50. In some embodiments, means for removing air 60 is an automatic air vent, e.g., air vent 64, while in other embodiments, means for removing air 60 is a manual air vent, e.g., air vent 66. It should be appreciated that aside from the ability to vent air, if such venting is included, the second circuit is a sealed system, i.e., the fluid within the fluid circuit is never exposed to the atmosphere and is typically under pressure provided by the pump.

In other embodiments, the present invention apparatus further comprises means for controlling a rate of flow 68 of second fluid 58 within second fluid circuit 50. Means for controlling the rate of flow 68 comprises valve 70 and valve 70 may include, but is not limited to, a gate valve, a plug valve, a globe valve, a butterfly valve, a diaphragm valve, a ball valve, a cone valve and a needle valve. As the structures of the foregoing valves are well known to one having ordinary skill in the art, depictions of each of these valves have not been included in the figures. Additionally, means for controlling a rate of flow 68 operates in the absence of internal recirculation. The absence of internal recirculation is intended to mean that the rate of flow of fluid in the fluid circuit that includes the hot side of the heat exchanger is controlled without recirculation of fluid within the apparatus, e.g., a recirculation loop whereby fluid never passes from the heat exchanger to a device. In the present invention, all flowing fluid that exits the hot side of the heat exchanger is passed to the connect device, and subsequently returned to the heat exchanger.

In still yet other embodiments, the present invention includes a pump, e.g., pump 72, 74 or 76. Depending on the needs and expense of the apparatus, the pump may be either a constant speed pump or a variable speed pump. The present invention may also comprise means for removing 78 second fluid 58 from second fluid circuit 50. Means for removing 78 may be a valve, e.g., valve 80, may be a plug or any other know means in the art. Moreover, in some embodiments, the present invention includes balance valve 82 arranged within second fluid circuit 50 and adapted to maintain a rate of flow of said second fluid within said second fluid circuit.

As can clearly be seen in the figures and in view of the foregoing, the present invention further comprises laboratory fume hood 10 having a present invention apparatus, e.g., apparatus 12, 16, 18 or 20 included therein. Fume hood 10 includes vented enclosure 84 having chilled fluid inlet 86 and chilled fluid outlet 88 position on an interior wall of enclosure 84. As described supra, the cold side of a heat exchanger, e.g., cold side 38 of heat exchanger 34, is in fluid communication with a chilled fluid supply. Thus, chilled fluid outlet 88 is connected to first inlet 44 and chilled fluid inlet 86 is connected to first outlet 46. The foregoing arrangement forms a first fluid circuit and a second fluid circuit is formed with and is in fluid communication with hot side 36. As described above, the present invention apparatus comprises means for introducing a second fluid within the second fluid circuit and is integral thereto, and further comprises a pump integral to the second fluid circuit and adapted to transmit a second fluid within the second fluid circuit. Again, as described supra, some embodiments of the present invention laboratory fume hood comprise a device in fluid communication and within the second fluid circuit and at least a portion of the device is cooled by the second fluid. For example, as shown in FIG. 1, reflux column 26 is cooled by the second fluid flowing therethrough while round bottom flask 28 is not directly affected by the second fluid.

In other embodiments, the present invention may further comprise a variety of aspects which enhance the apparatus' function and form. For example, the apparatus may be mounted on mounting plate 90 having through holes 92 arranged thereabout to facilitate releasably securing the apparatus within or proximate a fume hood or area where coolant fluid is desired. In such an arrangement, the heat exchanger may be fixedly secured to mounting plate 90 via mounting straps 94. Depending on the need to control temperature and pressure accurately, temperature sensors 96 and pressure sensors 98 may be arranged about the first and second fluid circuits, i.e., the cold and hot sides of the heat exchanger, respectively. Similarly, if needed, flow indicators may be included in the first and/or second fluid circuit, e.g., flow indicator 100, whereby the flow of fluid within the fluid circuit may be confirmed. Moreover, the second fluid circuit may further include shutoff valves 102 whereby the fluid within the hot side of the heat exchanger may be retained within the heat exchanger or whereby any devices connected to the heat exchanger may be removed and/or replaced. To facilitate the attachment of devices to the heat exchanger, the present invention may include nozzle connections, e.g., barbed fittings 104, whereon tubing may be releasably secured. Furthermore, the heat exchanger may be mounted to stand 106 whereby the present invention apparatus may merely be placed within a fume hood, for example, so that the apparatus may be moved from one location to another with minimal setup needed. As can be see in the figures, mounting plate 90 has surface area 108 and the heat exchanger, means for introducing the second fluid, pump and means for controlling the rate of flow of the second fluid are all arranged within the surface area. By maintaining a small surface area, e.g., one square foot, the present invention may be releasably secured within the fume hood without consuming valuable experimental space.

It should be appreciated that the present invention further comprises a method of providing coolant water to at least one device. A heat exchanger is mounted on an interior wall of a fume hood. Then, a first fluid is circulated from a chilled fluid supply, e.g., a building wide chilled fluid supply, within a cold side of a heat exchanger. A second fluid is introduced within a fluid circuit, and in this embodiment of the present invention, the fluid circuit is integral with a hot side of the heat exchanger. The second fluid is circulated within the fluid circuit via a pump. The at least one device is cooled via the second fluid.

Depending on the needs of the particular location and/or user of the present invention, the foregoing at least one device may include a plurality of devices and each of the plurality of devices is located within the fume hood, or alternatively, the at least one device may include a plurality of devices and at least one of the plurality of devices is located within the fume hood and at least one of the plurality of devices is located outside of the fume hood. It should be appreciated that the at least two devices may be located in a single fume hood using a plurality of present invention apparatus for providing coolant fluid, or using a single present invention apparatus having a plurality of devices arranged serially or in parallel with the present invention apparatus.

It should be appreciated in view of the foregoing embodiments, that the present invention apparatus for providing coolant fluid has a minimal volume, i.e., can be mounted within a fume hood, and provides cooling fluid in appropriate/modifiable pressure ranges, flow rates and temperature ranges. Moreover, the apparatus may be placed directly in the fume hood without issues arising due to the corrosive nature of the fume hood environment. The apparatus may be modified or scaled up to provide coolant fluid for any number of devices. The present invention isolates a building chilled fluid loop from the device chilled fluid loops thereby preventing flooding due to connection failures. In other words, if a faulty connection exists between the heat exchanger and a device, only the coolant fluid within that fluid circuit will leak from the system and thus damage due to leakage is minimal. Due to the simplicity of the apparatus' design, any failures or faulty parts may be easily isolated and fixed thereby resulting in high uptimes and minimal maintenance. Additionally, due to the arrangement of connections, the present invention apparatus can be moved from one location to another with a minimal setup and configuration. Lastly, as the foregoing embodiments of the invention show, the present invention apparatus provides cooling fluid in an environmentally friendly way and at a minimum cost.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. An apparatus for providing coolant fluid to a device, said apparatus comprising:

a heat exchanger having a hot side and a cold side, said cold side in fluid communication with a chilled fluid supply and adapted to receive a first fluid from said chilled fluid supply in a first inlet and return said first fluid from a first outlet of said cold side to said chilled fluid supply, said cold side and said chilled fluid supply forming a first fluid circuit, wherein the heat exchanger is connected to a mounting plate and the mounting plate is releasably connected to an interior wall of a fume hood;

a second fluid circuit in fluid communication with said hot side;

an opening configured to introduce a second fluid within said second fluid circuit and integral thereto;

a pump integral to said second fluid circuit and adapted to transmit a second fluid within said second fluid circuit; and, a valve for controlling a rate of flow of said second fluid within said second fluid circuit, wherein said device is within said second fluid circuit and said valve for controlling said rate of flow operates in the absence of internal recirculation.

2. The apparatus of claim 1 further comprising:

means for removing air from said second fluid circuit and said means for removing air from said second fluid circuit is an automatic air vent or a manual air vent.

3. The apparatus of claim 1 wherein said valve for controlling the rate of flow of said second fluid is at least one of: a gate valve, a plug valve, a globe valve, a butterfly valve, a diaphragm valve, a ball valve, a cone valve and a needle valve.

4. The apparatus of claim 1 wherein said pump is a constant speed pump or a variable speed pump.

5. The apparatus of claim 1 wherein said heat exchanger is a plate heat exchanger or a shell and tube heat exchanger.

6. The apparatus of claim 1 further comprising:

means for removing said second fluid from said second fluid circuit.

7. The apparatus of claim 1 wherein said valve for controlling said rate of flow of said second fluid is a balance valve and said balance valve is configured to maintain a rate of flow of said second fluid within said second fluid circuit.

8. The apparatus of claim 1 wherein said second fluid circuit is a sealed system.

9. The apparatus of claim 1 wherein the mounting plate further includes:

a surface area, wherein said heat exchanger, said means for introducing said second fluid, said pump and said valve for controlling the rate of flow of said second fluid are all arranged within said surface area.

10. A laboratory fume hood comprising the apparatus of claim 1 arranged within the fume hood.

11. The apparatus of claim 1 further including means for removing the second fluid from the second fluid circuit.

12. The apparatus of claim 1, wherein the opening configured to introduce the second fluid within the second fluid circuit further includes a connection point for a hose.

13. The apparatus of claim 1 further comprising a shut-off valve integral to said second circuit such that said laboratory device may be removed and/or replaced with another laboratory device.

14. A laboratory fume hood comprising:

a vented enclosure having a chilled fluid inlet and a chilled fluid outlet arranged therein;

a heat exchanger having a hot side and a cold side, said cold side in fluid communication with a chilled fluid supply via said chilled fluid inlet and outlet and configured to receive a first fluid from said chilled fluid outlet in a first inlet and return said first fluid from said cold side to said chilled fluid inlet via a first outlet, said cold side and said chilled fluid supply forming a first fluid circuit, the heat exchanger being releasably connected to the vented enclosure;

a second fluid circuit in fluid communication with said hot side;

means for introducing a second fluid within said second fluid circuit and integral thereto;

a pump integral to said second fluid circuit and adapted to transmit the second fluid within said second fluid circuit; and a valve for controlling a rate of flow of said second fluid within said second fluid circuit, wherein a device is within said second fluid circuit and said valve for controlling said rate of flow operates in the absence of internal recirculation.

15. The laboratory fume hood of claim 14 wherein said vented enclosure further comprises at least one interior wall and said heat exchanger is connected to said at least one interior wall.

16. The laboratory fume hood of claim 14 further comprising:

said device in fluid communication and within said second fluid circuit, wherein at least a portion of said device is cooled by said second fluid.

17. The laboratory fume hood of claim 16 wherein said device is selected from the group consisting of: a rotary evaporator, a laser, a distillation column, a condenser column and combinations thereof.

18. The laboratory fume hood of claim 16, wherein the device is located within the vented enclosure.

19. A method of providing coolant fluid to at least one device comprising the steps of:

releasably mounting a heat exchanger on an interior wall of a fume hood;

circulating a first fluid from a chilled fluid supply within a cold side of said heat exchanger;

introducing a second fluid within a fluid circuit, said fluid circuit integral with a hot side of said heat exchanger;

circulating said second fluid within said fluid circuit via a first pump, wherein the fluid circuit comprises a valve for controlling a rate of flow of said second fluid within said fluid circuit, wherein said at least one device is within said fluid circuit and said valve for controlling said rate of flow operates in the absence of internal recirculation; and, cooling said at least one device via said second fluid.

20. The method of providing coolant fluid recited in claim 19 wherein said at least one device comprises a plurality of devices and each device of said plurality of devices is located within said fume hood.

21. The method of providing coolant fluid recited in claim 19 wherein said at least one device comprises a plurality of devices and at least one device of said plurality of devices is located within said vented enclosure and at least one of said plurality of devices is located outside of said fume hood.

* * * * *